US007070387B2

(12) United States Patent
Crozet et al.

(10) Patent No.: US 7,070,387 B2
(45) Date of Patent: Jul. 4, 2006

(54) GAS TURBINE STATOR HOUSING

(75) Inventors: Francois Crozet, Yerres (FR); Daniel Didier, Corbeil (FR); Christian Ducrocq, Varennes-Jarcy (FR); Sebastien Imbourg, Yerres (FR); Laurent Palmisano, Yerres (FR); Jean-Marc Rongvaux, La Norville (FR); Andrë Verbrugge, Combs la Ville (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/486,831

(22) PCT Filed: Aug. 28, 2002

(86) PCT No.: PCT/FR02/02948

§ 371 (c)(1),
(2), (4) Date: Feb. 20, 2004

(87) PCT Pub. No.: WO03/018962

PCT Pub. Date: Mar. 6, 2003

(65) Prior Publication Data

US 2004/0184912 A1 Sep. 23, 2004

(30) Foreign Application Priority Data

Aug. 30, 2001 (FR) ..... 01 11232

(51) Int. Cl.
*F01D 11/12* (2006.01)
*F01D 9/04* (2006.01)
*F01D 25/12* (2006.01)

(52) U.S. Cl. ..... 415/173.1; 415/173.4; 415/173.5; 415/175; 415/178; 415/189; 415/190; 415/209.3; 415/173.6

(58) Field of Classification Search ..... 415/209.2, 415/209.3, 209.4, 189, 190, 116, 173.1–173.5, 415/175–178
See application file for complete search history.

(56) References Cited

U.S. PATENT DOCUMENTS

| | | | | |
|---|---|---|---|---|
| 4,019,320 | A * | 4/1977 | Redinger et al. | 415/116 |
| 4,101,242 | A * | 7/1978 | Coplin et al. | 415/178 |
| 4,131,388 | A | 12/1978 | Brodell | |
| 4,522,559 | A * | 6/1985 | Burge et al. | 415/177 |
| 4,529,355 | A * | 7/1985 | Wilkinson | 415/173.1 |
| 4,925,365 | A * | 5/1990 | Crozet et al. | 415/170.1 |
| 5,145,316 | A | 9/1992 | Birch | |
| 5,180,281 | A | 1/1993 | Burge et al. | |
| 5,288,206 | A * | 2/1994 | Bromann et al. | 415/209.2 |
| 5,616,003 | A * | 4/1997 | Charbonnel et al. | 415/209.3 |
| 5,630,702 | A * | 5/1997 | Marmilic et al. | 415/177 |
| 5,653,581 | A | 8/1997 | Dixon et al. | |
| 6,149,074 | A * | 11/2000 | Friedel et al. | 415/175 |
| 6,179,560 | B1 * | 1/2001 | Kouris et al. | 415/209.4 |

FOREIGN PATENT DOCUMENTS

EP 0 618 349 10/1994

(Continued)

*Primary Examiner*—Christopher Verdier
(74) *Attorney, Agent, or Firm*—Oblon, Spivak, McClelland, Maier & Neustadt, P.C.

(57) ABSTRACT

A housing including an outer casing provided with bearer hooks for stator rings and sealing rings. The hooks are discontinuous angularly and joined to a casing by tenon and mortise assemblies. The hooks and the casing may therefore be made in different materials, the hook material having good resistance to heating and the other material lending itself better to machining and forming. Ventilation, clearance piloting and heat protection are facilitated.

14 Claims, 4 Drawing Sheets

FOREIGN PATENT DOCUMENTS

| | | | | | |
|---|---|---|---|---|---|
| EP | 0 651 139 | 5/1995 | | | |
| FR | 2 683 851 | 5/1993 | | | |
| GB | 2 076 071 | 11/1981 | | | |
| GB | 2 115 487 | 9/1983 | | | |
| GB | 2226365 A | * | 6/1990 | ..... | 415/173.3 |

* cited by examiner

GAS TURBINE STATOR HOUSING

The present invention pertains to a housing for a turbomachine stator.

In addition to an outer jacket forming the stator casing, said housing comprises bearer parts, generally curved into hooks, giving support to rings carrying fixed vane and blade sets. These hooks extend the structure of the housing as far as close to the gas stream and are therefore subjected to much greater heating than the casing. The unfavourable position of the hooks requires special precautions to protect them from heating, at the expense of largely complicating machine structure at this point and without such attempts being completely successful, since the hooks may nonetheless necessitate early repair.

The invention relates to an improved housing that is both less costly and easy to manufacture, more durable, with a rather more simplified structure and which requires less protection against heat.

In its more general form, it is a stator housing comprising a casing and ring bearer parts on an inner surface of the casing, the bearer parts being separate from the casing, joined to the casing by assembly means and only extending over sectors of a circle, characterized in that the bearer parts comprise hooks provided with opposite grooves giving support to at least two of the rings, the rings consisting of sealing rings alternating with stator rings carrying fixed blades, the stator rings being joined to the bearer parts by portions extending along their outer side in radial direction. It arises from this definition that continuous housing structure is abandoned and that the bearer parts are added to the casing.

The advantages of this construction are immediately discernable: the ring bearer parts, being added to the housing, can be manufactured separately at less cost, replaced at will and made in a different material to the housing; some of these parts at least (called hooks) carry both a stator ring and an adjacent sealing ring thereby allowing direct hooking of all the rings to the housing, which improves the accuracy and stability of the assembly; finally, hooking of the stator rings by radial outer portions makes it possible to move the hooks away from the gas stream and hence to reduce their heating and the heat they transmit to the housing.

Document GB 2 115 487 A describes a device with added bearer parts on a housing, but these parts only carry the sealing rings; the stator rings overlap and are supported by the sealing rings; this assembly has the disadvantage of being scarcely rigid since the stator rings (subjected to substantial aerodynamic loads) are not borne by the housing, and it is more subject to heat expansion since the bearer parts, like the sealing rings which bear the stator rings, extend as far as the gas stream or close to it.

The invention is described in more detail in connection with the figures given below;

Figure 1:
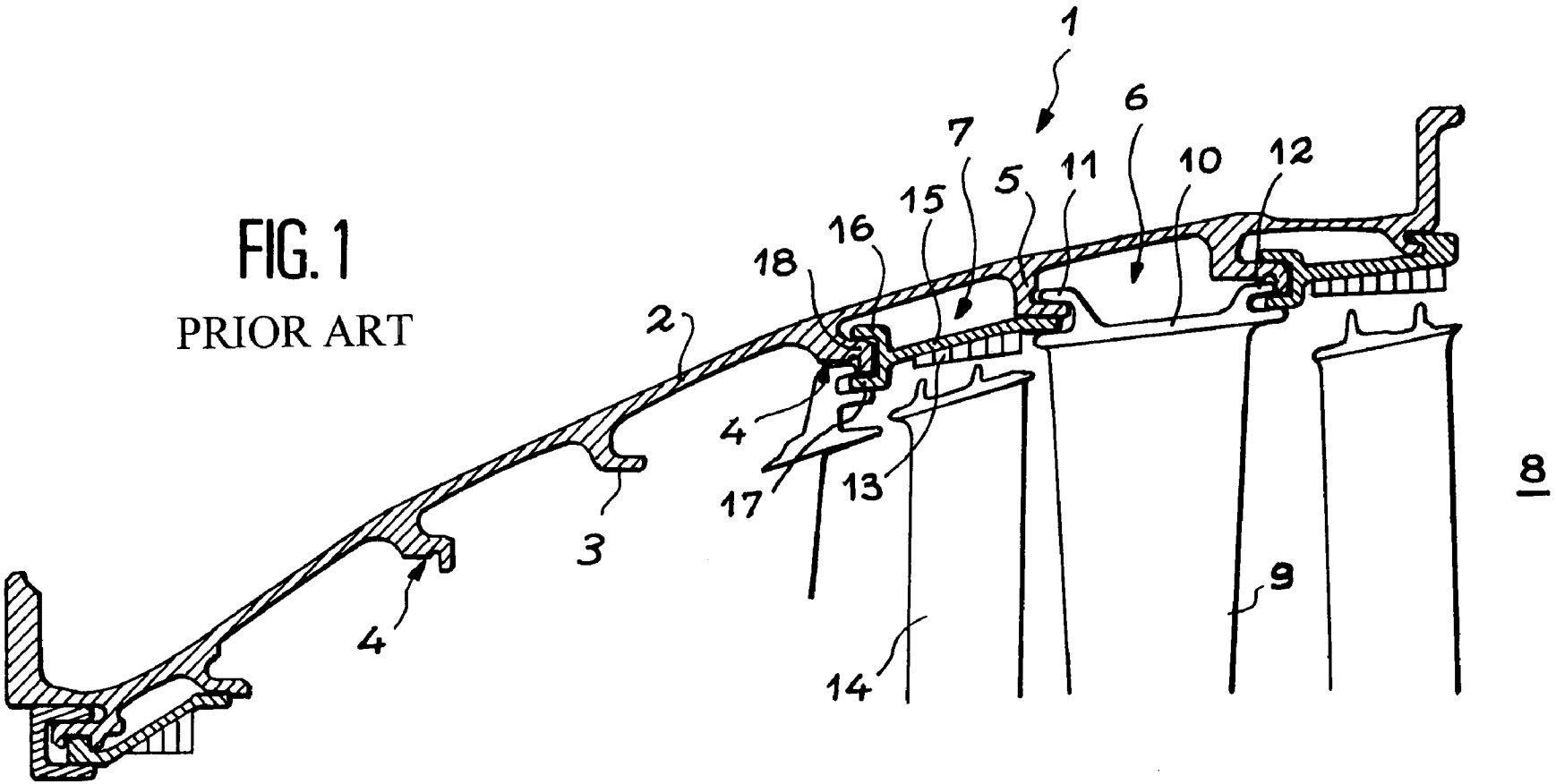
FIG. 1 PRIOR ART
FIG. 1 illustrates a design of the prior art.

The stator of a known type in FIG. 1 is provided with a housing consisting of an outer casing 2 and hooks of which two main types are found: flat hooks 3 and heeled hooks 4 alternating along the axis of the machine. All the hooks 3 and 4 are circular and joined to casing 2 by a wing 5 with no structure discontinuity. They carry alternating stator rings 6 and sealing rings 7 which together form a lining for the housing, insulating it from a gas flow stream 8 of the machine. These rings 6 and 7 are made up of juxtaposed ring sectors joined by sealing lugs housed in grooves opposite adjacent structures.

Stator rings 6 carry fixed blades and comprise a base plate 10 provided with hooks 11 and 12 at the front and rear of the outer side. The sealing rings 7 carry linings 13 in abradable material extending in front of the ends of mobile blades 14 and comprise a base plate 15 ending at the front in an outer hook 16 and an inner hook 17. These hooks 16 and 17 are arranged so that they surround heel 18 of hooks 4 while holding the rear hooks 12 of stator rings 6 on said hooks 4. The base plates 15 of the sealing rings 7 bear upon on simple hooks 3 at the rear, and this assembly is surrounded by base plate 10 and front hooks 11 of stator rings 6.

The assembly so obtained is rigid but complicated: it allows hooks 3 and 4 to be covered by the ends of rings 6 and 7 without exposing them directly to the high temperature of the gases of stream 8. But this protection is insufficient, especially as leakages of hot gas towards housing 1 remain possible despite gaskets which may be provided in particular between the angular sectors of rings 6 and 7: in practice housing 1 must be cooled by a stream of cool ventilation air drawn from another part of the machine which is blown into the chambers delimited by casing 2, hooks 3 and 4 and rings 6 and 7.

Figure 2:
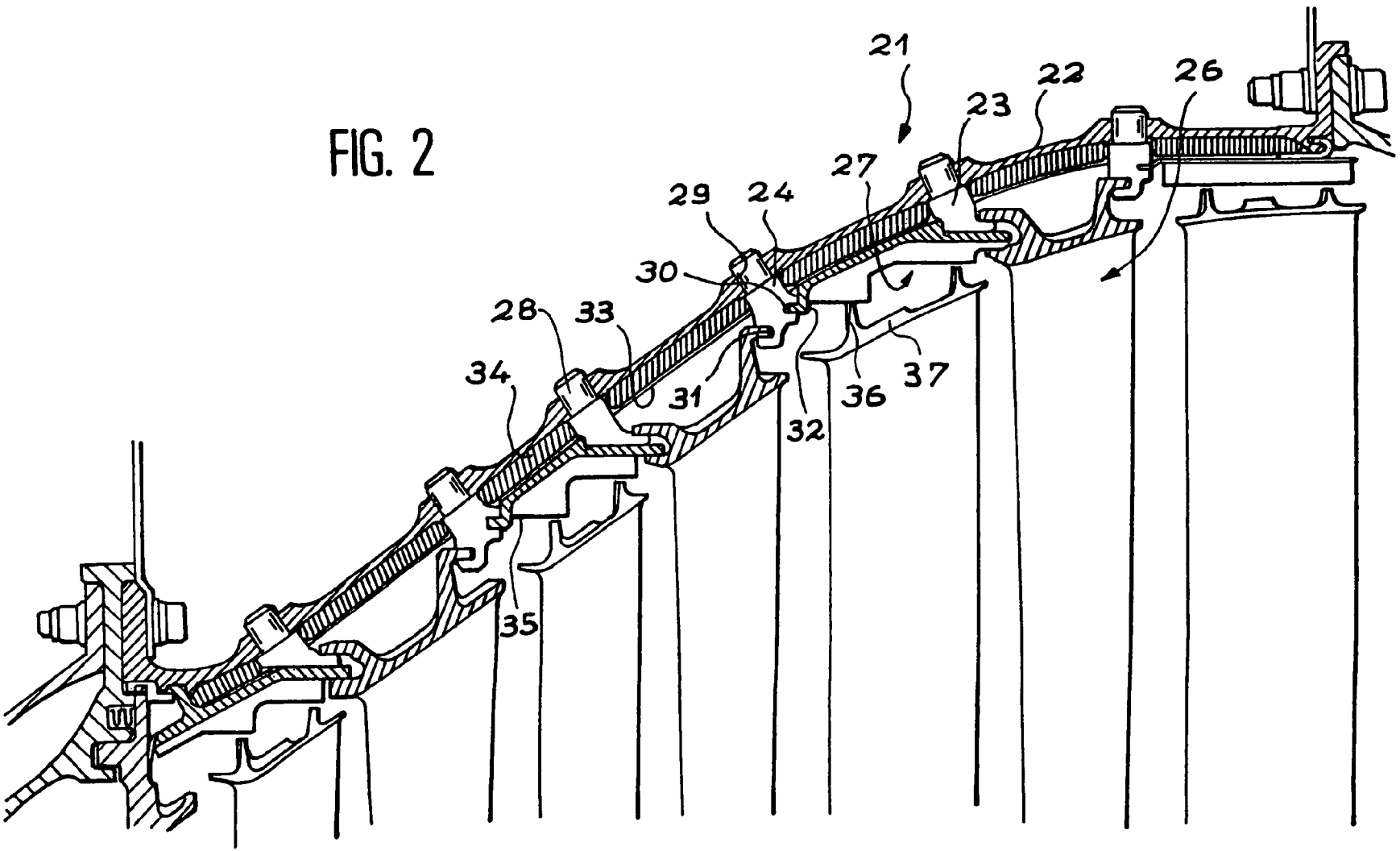
FIGS. 2 and 3 show two possible embodiments of the invention.
Figure 4:
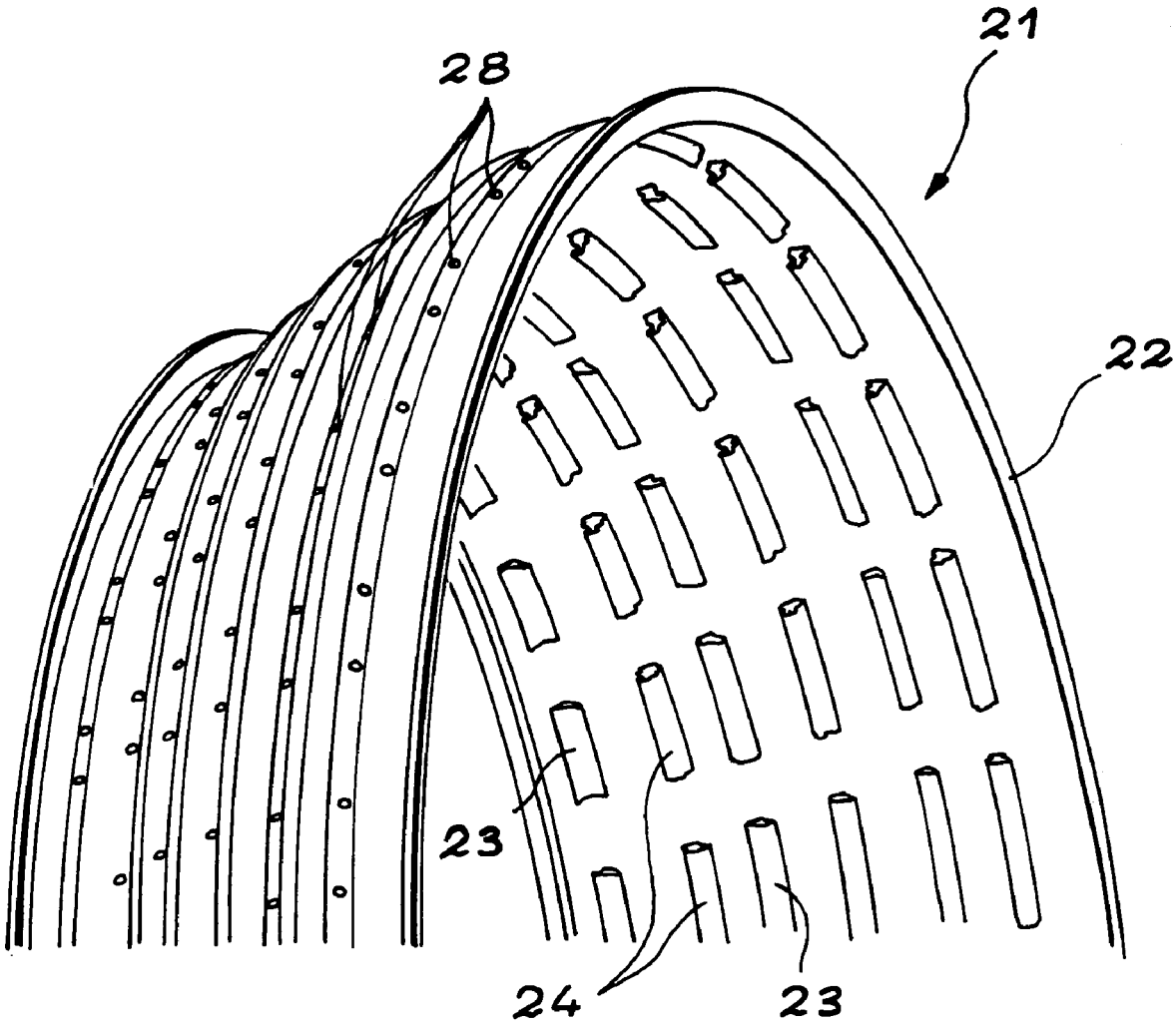
FIG. 4 is a perspective view of the first of these embodiments.

The housing 21 in FIG. 2 comprises, as previously, an outer casing 22 and hooks 23 and 24 of different types alternating along the machine and which also serve to support stator rings 26 and sealing rings 27 which also alternate; but hooks 23 and 24 have the specificity (see also FIG. 4) of extending only over sectors of a circle, of being distributed in circular rows and of each comprising tenons 28 crossing through respective mortises 29 of casing 22. Fixing of hooks 23 and 24 to casing 22 is obtained by binding, welding or bolting.

Since casing 22 and hooks 23 and 24 are separate parts, it becomes possible for them to be made in different materials: hooks 23 and 24 may be in alloys with good resistance to heating (and optionally different depending upon the positioning of the hook under consideration and surrounding temperature), which was not possible up until now; and casing 22 may be in a more ordinary alloy, less costly and easier to form. It is to be noted that the greater ease of manufacture offered by separate manufacturing of casing 22 and hooks 23 and 24 is another source of savings.

While hooks 23 are simple hooks similar to hooks 3, hooks 24 are different from heeled hooks 4 and in this case comprise a pair of opposite grooves 30 and 31; the design of the stator rings 26 is similar to preceding rings 6 as is that of sealing rings 27. Hooks 24 which replace hooks 4 are now exposed to gases of stream 8, but this is not detrimental now that it is possible for them to be made in a material sufficiently resistant to heat such as M509 (KC24NWTZ) for a temperature of over 900° C. or RENE77 (NK15CADT) for lower temperatures.

It will also be noted that in this design, sealing rings 27 are recessed relative to stator rings 26, i.e. they do not extend the latter but are close to outer casing 22; they no longer serve to delimit the periphery of the gas flow stream and simply carry a layer of abradable material 35 which forms a seal with circular crests 36 arranged outside peripheral rings 37 which surround the mobile blades 14. The peripheral rings 37 extend the stator rings 26 and it is these therefore which truly delimit the stream of gas flow, in advantageous manner since its section varies in much more continuous fashion than in the design in FIG. 1. This effect can be attributed to the radial level difference between grooves 30 and 31 and hooks 24. Good continuity of the stream was also achieved in the design in which the stator and sealing rings overlapped but the assembly was more complicated and the mobile blades were devoid of a peripheral ring which greatly contributes to their cohesion.

Outer casing 22 may be protected by a lining comprising an inner jacket 33 and lagging 34 between inner jacket 33 and casing 22. Inner jacket 33 and lagging 24 may easily be fitted by making cut-outs enabling hooks 23 and 24 to pass through them. Since hooks 23 and 24 do not form continuous circles, inner jacket 33 and lagging 34 remain in one piece and may therefore be easily installed and held in place without any special precautions even if inner jacket 33 is a fairly flexible metal sheet: it can for example bear upon sealing rings 27.

Lagging 34 offers passive protection against heat which in no way contributes towards cooling hooks 23 and 24, unlike a ventilation system; but hooks in more refractory material often no longer require cooling whereas lagging 34 can easily be closely modelled around hooks 23 and 24 which eliminates leakages of hot gas towards casing 22; it offers the additional advantage, similar to inner jacket 33, of extending in front of the sector junctions of rings 26 and 27 and of supplementing the gaskets installed at this point which may henceforth be omitted; the sectors of rings 26 and 27 are then juxtaposed with clearance, their edges being simple without any grooves or other means for housing intermediate joints, and gas leakages from the stream can be tolerated as far as inner jacket 33.

It will be understood that lagging 34 is a preferred protection means for casing 22; it is not incompatible with limited cooling of hooks 23 and 24 (via a system described below) but recourse may be made to active ventilation if it is insufficient; the inner jacket 33 will subsist to stop leakages of hot gas and to channel ventilation air into the space that is now empty between it and casing 22.

Figure 3:
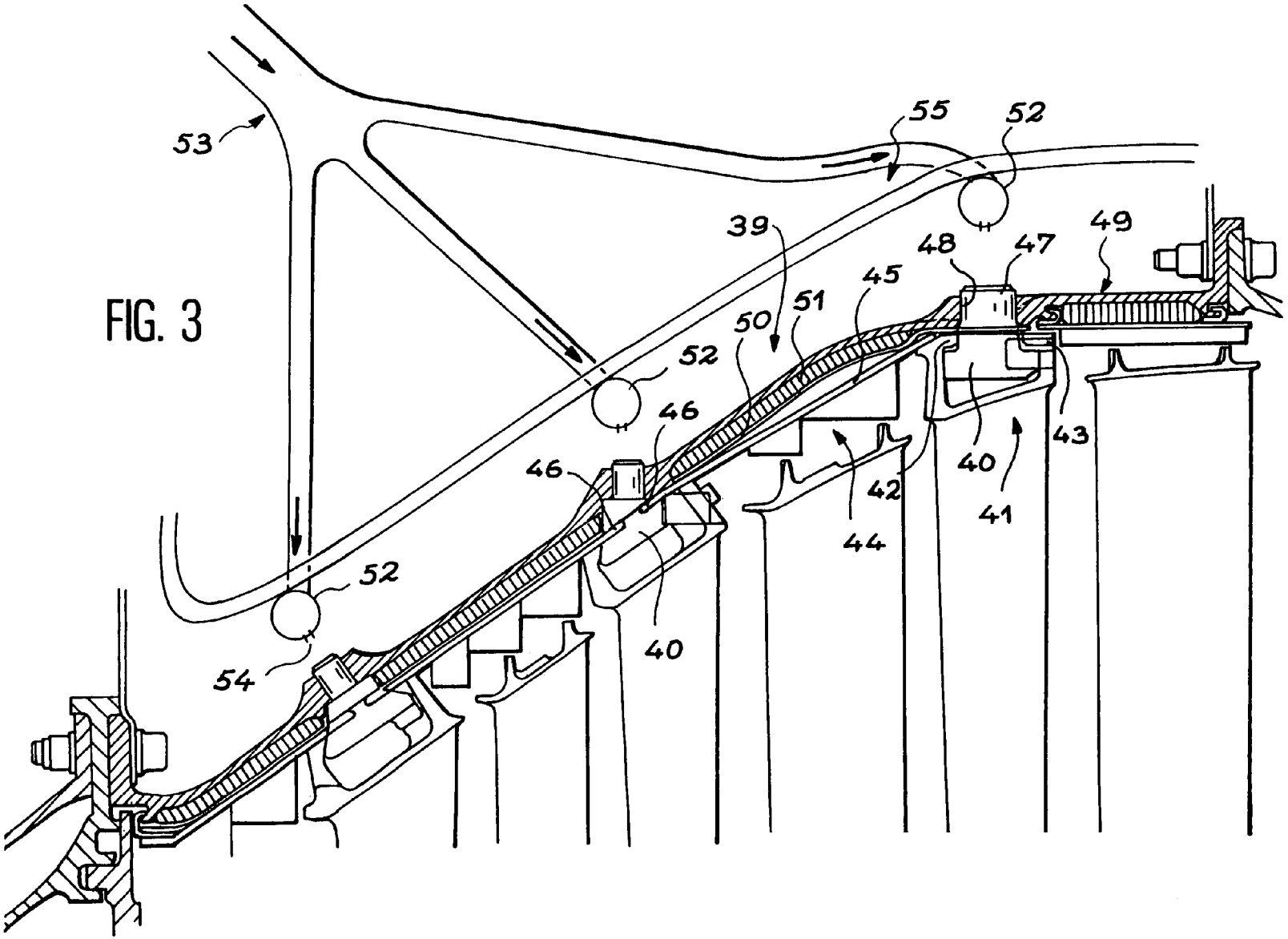

The design of housing 39 in FIG. 3 differs substantially from the preceding one in that the hooks of both types are replaced by hooks 40 of a single type of which each one comprises a widened dovetail or T end to bear a respective stator ring 41 which is provided on its outer side with two hooks 42 and 43 oriented towards one another and which engage upon the widened parts of the end of hooks 40. This implies that hooks 40 and stator rings 41 are positioned on the same cross sections of the machine and that each stator ring 41 is borne by a single row of hooks 40; this solution comprises twice as less hooks than the preceding solutions, and sealing rings 7 and 27 are replaced by sealing rings 44 that are wider with base plates 45 devoid of hooks and whose ends fit into grooves 46 of hooks 40. As in the preceding embodiment, hooks 40 are provided with pairs of tenons 47 passing through corresponding mortises 48 of an outer casing 49 of housing 39. Again, an inner jacket 50 provided with lagging 51 can be fitted to insulate casing 49.

One function that often has to be met in turbomachines is the piloting of radial clearance so as to improve machine efficiency at certain speeds. This is achieved, as in known designs, via air blowing devices consisting of perforated annular ramps 52 surrounding housing 39, and best arranged in front of its most solid parts, formed here by rows of hooks 40. Ramps 52 are supplied by a feeder 53 dividing itself towards each ramp and the blown air exits ramps 52 through pierced holes 54 oriented towards tenons 47 of hooks 40. Cooling of housing 39, to greater or lesser extent, allows adjustment of its temperature and corresponding expansion, and hence adjustment of the clearance between the blade ends and the sealing devices which in particular comprise rings 44. A sheet of metal 55 surrounding housing 39 may be added to channel blown air towards an outlet; if it entirely covers ramps 52, the appearance of the device is improved.

This device, especially designed to pilot clearance, may also optionally be used for direct ventilation of hooks 40 by blowing air onto tenons 47, and of casing 49 with blown air passing over it; in this particular embodiment, it only requires a limited number of ramps 52 since the number of rows of hooks is reduced. A similar device could be fitted to the embodiment in FIG. 2.

The invention claimed is:

1. A stator housing comprising:

a casing and bearer parts for rings on an inner surface of the casing, the bearer parts being separate from the casing, joined to the casing by an assembly means and only extending over sectors of a circle, wherein the bearer parts comprise hooks provided with opposite grooves giving support to at least two of the rings, the rings including sealing rings alternating with stator rings carrying fixed blades, the stator rings being joined to the bearer parts by portions extending over their outer side in a radial direction, wherein the assembly means comprises one or more tenons for each bearer part and mortises made in the casing and occupied by the tenons.

2. A stator housing as in claim 1, wherein the rings are assembled to the bearer parts so as to leave said hooks partly exposed, one of the grooves giving support to one of the sealing rings and the other groove giving support to one of the stator rings.

3. A stator housing as in claim 1, wherein the tenons cross through the casing, and an air blowing system by circular ramps surrounds the casing, the ramps being perforated in front of the tenons.

4. A stator housing as in claim 1, wherein the bearer parts and the casing are made of different materials.

5. A stator housing as in claim 1, wherein the sealing rings are recessed towards the casing relative to the stator rings.

6. A stator housing as in claim 1, wherein the hooks are made of different materials depending on an axial position of the hooks in the housing and a surrounding temperature inside the casing.

7. A stator housing comprising:

a casing and bearer parts for rings on an inner surface of the casing, the bearer parts being separate from the casing, joined to the casing by an assembly means and only extending over sectors of a circle, wherein the bearer parts comprise hooks provided with opposite grooves giving support to at least two of the rings, the rings including sealing rings alternating with stator rings carrying fixed blades, the stator rings being joined to the bearer parts by portions extending over their outer side in a radial direction, wherein the bearer parts are hooks of a single type with widened ends, each supporting a stator ring carrying fixed blades, and are distributed in circular rows in identical number to said stator rings carrying fixed blades, the sealing rings having ends that are either positioned on portions of the stator rings borne by the hooks, or which fit into the grooves of the hooks.

8. A stator housing as in claim 7, wherein the bearer parts and the casing are made of different materials.

9. A stator housing as in claim 7, wherein the sealing rings are recessed towards the casing relative to the stator rings.

10. A stator housing as in claim 9, wherein a periphery of a gas flow stream inside the housing is delimited by the stator rings and by peripheral rings surrounding mobile blades.

11. A stator housing as in claim 7, wherein the hooks are made of different materials depending on an axial position of the hooks in the housing and a surrounding temperature inside the casing.

12. A stator housing as in claim 11, wherein the different materials comprise M509 for a surrounding temperature over 900° C. and RENE77 for lower surrounding temperatures.

13. A stator housing comprising:

a casing and bearer parts for rings on an inner surface of the casing, the bearer parts being separate from the casing, joined to the casing by an assembly means and only extending over sectors of a circle, wherein the bearer parts comprise hooks provided with opposite grooves giving support to at least two of the rings, the rings including sealing rings alternating with stator rings carrying fixed blades, the stator rings being joined to the bearer parts by portions extending over their outer side in a radial direction, and a jacket inside the casing, separated from the casing by a space and formed of a continuous sheet through which the bearer parts pass at points where the jacket is pierced.

14. A stator housing as in claim 13, further comprising lagging filling the space.

* * * * *